US010443203B2

(12) United States Patent
Gunter

(10) Patent No.: US 10,443,203 B2
(45) Date of Patent: Oct. 15, 2019

(54) PILE DRIVING GUIDE

(71) Applicant: IHC IQIP UK LTD., Dorset (GB)

(72) Inventor: David Howel Gunter, Dorset (GB)

(73) Assignee: IHC IQIP UK LTD., Blandford Forum Dorset (GB)

( * ) Notice: Subject to any disclaimer, the term of this patent is extended or adjusted under 35 U.S.C. 154(b) by 0 days.

(21) Appl. No.: 14/770,271

(22) PCT Filed: Feb. 28, 2014

(86) PCT No.: PCT/EP2014/053941
§ 371 (c)(1),
(2) Date: Aug. 25, 2015

(87) PCT Pub. No.: WO2014/131886
PCT Pub. Date: Sep. 4, 2014

(65) Prior Publication Data

US 2016/0002875 A1 Jan. 7, 2016

(30) Foreign Application Priority Data

Feb. 28, 2013 (NL) ..... 2010375

(51) Int. Cl.
*E02D 13/04* (2006.01)
*E02D 7/00* (2006.01)

(52) U.S. Cl.
CPC ..... *E02D 13/04* (2013.01); *E02D 7/00* (2013.01)

(58) Field of Classification Search
CPC ..... E02D 13/04
(Continued)

(56) References Cited

U.S. PATENT DOCUMENTS 2,651,181 A 9/1953 Alcorn
3,827,508 A 8/1974 MacKinnon
(Continued)

FOREIGN PATENT DOCUMENTS

CN 202298623 U 7/2012
CN 202466592 U 10/2012
(Continued)

OTHER PUBLICATIONS

European Search Report and the Written Opinion of the European Patent Office Patent Office in counterpart foreign application No. 10155673.6 filed Mar. 5, 2010.
(Continued)

*Primary Examiner* — Tara Mayo-Pinnock
(74) *Attorney, Agent, or Firm* — Steven M. Koehler; Westman, Champlin & Koehler, P.A.

(57) ABSTRACT

A pile guide is provided comprising a base frame and a superstructure comprising a pile guide member for guiding the pile as it is driven into a substrate when the base frame is resting thereon. At least part of the superstructure defines an arm that is rotational with respect to the base frame about a first and second points of rotation, to rotate the pile guide member with respect to the base frame. At least one of the first and second points of rotation is translatable with respect to the base frame in a first direction, thereby rotating the arm about the first and second points of rotation with respect to the base frame. At least one of the first and second points of rotation is translatable in a second direction substantially perpendicular to the first and second points of rotation with respect to the base frame direction. A method is also provided.

20 Claims, 3 Drawing Sheets

(58) Field of Classification Search
USPC ..... 405/232
See application file for complete search history.

(56) References Cited

U.S. PATENT DOCUMENTS

| | | | |
|---|---|---|---|
| 4,102,094 | A | 7/1978 | MacKinnon |
| 4,127,991 | A | 12/1978 | Regan |
| 4,154,552 | A | 5/1979 | Van Bilderbeek |
| 4,408,932 | A | 10/1983 | Cowan |
| 4,822,212 | A | 4/1989 | Hall |
| 6,234,260 | B1 | 5/2001 | Coast |
| 6,305,882 | B1 | 10/2001 | Coast |
| 6,749,371 | B2 | 6/2004 | Jones |
| 7,585,133 | B2 | 9/2009 | Jones |
| 8,672,587 | B2 | 3/2014 | Mack |
| 9,145,654 | B2 | 9/2015 | Berry |
| 2003/0077127 | A1 | 4/2003 | Jones |
| 2009/0129870 | A1 | 5/2009 | Jones |
| 2009/0166092 | A1 | 7/2009 | Jones |
| 2009/0252925 | A1 | 10/2009 | Provoost |
| 2011/0211917 | A1 | 1/2011 | Jones |
| 2012/0301226 | A1 | 11/2012 | Mack |
| 2012/0315097 | A1 | 12/2012 | Paulus |
| 2013/0043211 | A1 | 2/2013 | Vermeulen |

FOREIGN PATENT DOCUMENTS

| | | | | |
|---|---|---|---|---|
| EP | 1036886 | | 9/2000 | |
| EP | 1304415 | | 4/2003 | |
| EP | 2325398 | | 5/2011 | |
| EP | 2532790 | | 12/2012 | |
| EP | 2532790 | A1 | 12/2012 | |
| GB | 2476823 | A | 3/2011 | |
| WO | 9911872 | | 3/1999 | |
| WO | 0192645 | | 12/2001 | |
| WO | 03074795 | | 9/2003 | |
| WO | 2006109018 | | 10/2006 | |
| WO | 2007066078 | | 6/2007 | |
| WO | 2009024739 | | 2/2009 | |
| WO | 2010015799 | | 2/2010 | |
| WO | 2010043845 | | 4/2010 | |
| WO | 2010092351 | | 8/2010 | |
| WO | 2010112832 | | 10/2010 | |
| WO | 2011083324 | | 7/2011 | |
| WO | WO 2012/143697 | * | 10/2012 | ..... E02D 13/04 |

OTHER PUBLICATIONS

Chinese Office Action for Chinese patent application No. 201480010257.3, dated Jul. 13, 2016.
International Search Report and Written Opinion for corresponding foreign application PCT/EP2014/053941, filed Feb. 28, 2014.

* cited by examiner

PILE DRIVING GUIDE

CROSS-REFERENCE TO RELATED APPLICATION

The present application is a national stage filing of International patent application Serial No. PCT/EP2014/053941, filed Feb. 28 2014, and published as WO 2014/131886 A1 in English.

TECHNICAL FIELD

The invention relates to pile driving, and more particularly, but not exclusively, to underwater pile driving, e.g. for stabbing piles directly into the seabed.

BACKGROUND ART

The discussion below is merely provided for general background information and is not intended to be used as an aid in determining the scope of the claimed subject matter.

It is known to provide pile guides for underwater piling, see for example, a range of pile guides as described in WO 99/11872 (Fast Frame pile guide), WO 01/92645 (Finned Frame/Follower pile guide) and WO 03/074795 (Orientation Control pile guide). With such pile guides, piles may be driven into the seabed using hydraulic hammers, such as the IHC Hydrohammers.

Another pile guide as described in WO 2009/024739 was specifically devised to for pile driving into an inclined substrate, such as the inclined side of a seabed canyon. The pile guide comprises a pile guide member which is pivotally mounted on a base frame to enable the pile guide member to pivot around an axis of rotation relative to the base frame. With such an arrangement, the orientation of the pile guide member may be adjusted to guide piles in a vertical orientation when the base frame rests on an inclined substrate with the axis of rotation horizontal (i.e. transversely to the direction of inclination). However, such pile guides are not ideally suited for driving a pile into an uneven or undulating underwater substrate with localised variations in level. This is because such an underwater substrate will have a tendency to support the pile guide at different angles to the horizontal in different locations, which would result in piles being driven into the substrate in different, non-vertical orientations.

Yet another pile guide, as described in WO 2011/083324 was devised to allow for pile driving into an uneven or undulating underwater substrate with localised variations in level. The pile guide comprises a pile guide member mounted on a base frame via a plurality of support members of variable length, with length adjustment of each of the plurality of support members determining the orientation of the pile guide member relative to the base frame. However, with such an arrangement, the variable length support members must be strengthened or protected to withstand lateral loads experienced by the pile guide during use.

It is noted that EP 2 325 398 describes a different approach to a system of extending piles into a seabed at an adjustable angle to the seabed level. The system comprises a guiding apparatus having a plurality of pile guiding elements interconnected by connection elements, each pile guiding element having respective guiding means and support elements. In the shown embodiment, the guiding means comprise a tubular element having a first central axis and the support element comprises a frusto-conical tubular element having a second central axis, and a portion of the guiding means is adjustably extendible inside the frusto-conical tubular element by adjustment of articulation means. However, the guiding elements of such system cannot laterally open to remove the guide from the pile and pile driving depth is restricted since the pile driving hammer cannot pass the guiding element.

In view of the above, there is a desire for further improvements.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

In accordance with an aspect of the present invention, a pile guide is provided, comprising a base frame and a superstructure. The superstructure comprises a pile guide member for guiding the pile in a predetermined direction as it is driven into a substrate when the base frame is resting thereon. At least part of the superstructure defines an arm that is rotational with respect to the base frame about a first point of rotation and a second point of rotation, to rotate the pile guide member with respect to the base frame. At least one of the first and second points of rotation is translatable with respect to the base frame in a first direction, thereby rotating the arm about the first and second points of rotation with respect to the base frame. At least one of the first and second points of rotation is translatable in a second direction substantially perpendicular to the first direction.

Such pile guide facilitates use and has improved reliability. It also provides increased robustness and longevity.

The presently provided improvements rely on the notion that, when rotating a cantilevered arm about a pivot, the free end of the arm rotates in an arc and the projection of the arm on a reference plane perpendicular (or at least non-parallel) to the plane of rotation exhibits a cosine-behavior.

If a generally rigid arm is part of an assembly wherein it is connected to another structure, here the base frame, in two points and rotates, the connections will define points of rotation of the arm with respect to the other structure. Whether the center of rotation of the arm coincides with one of the points of rotation depends on whether a point of rotation is fixed or that both points of rotation are movable with respect to the other structure.

If the connections between the arm and the other structure are arranged for purely linear displacement, at least part of the assembly is put under stress. Such stresses on the construction increase upon increasing the inclination. The stresses also increase with increasing size of the pile guide and in particular the superstructure. Both occur in prior art pile guides, leading to deformation, wear and/or damage of the structure.

In the presently provided pile guide and method, stresses are reduced or prevented by the transverse translation of at least one of the points of rotation, which facilitates absorbing variation and/or preventing deformation.

The present solution contrasts that of WO 2011/083324 which teaches to maintain the relative lateral separation between the points of rotation to which a pivoting axis was connected, by sliding the pivoting axis within a joint so that the length of the arm is adjustable. An adjustable arm length is not always possible and it may cause shifted loads and/or wear, and constructions may be relatively delicate and need fortification. The presently provided pile guide may be constructed more robust.

In an embodiment, the first direction is substantially perpendicular to the base frame. This facilitates operation of the pile guide and adjustment of the rotation of the superstructure.

In an embodiment, at least one of the first and second points of rotation is floatable in a second direction substantially perpendicular to the first direction. Thus, a further degree of freedom is provided which prevents unwanted stresses in the pile guide so that, as a result, reliability of the device is improved and use is facilitated. The floatability may be such that a projection of the arm on the base frame, on the superstructure or on another object retains substantially constant length.

In an embodiment, at least part of the pile guide member defines the arm. In such case, stress on (part of) the guide member may be prevented. Such stress may otherwise focus in relatively weak spots. For instance, the guide may comprise plural guide parts that are each moveable between a operative position and an inoperative position, each guide part being pivotally mounted on the base frame about a respective pivoting axis, and comprising one or more structures to maintain the guide part in a predetermined shape, e.g. at least some of the guide parts being connected with a latch, the structure (e.g. latch) preferably being controllable. Any stresses on the pile guide may result in deformation of the guide member, which in turn may result in (partial) separation of the guide parts and concentration of stresses in (one or more parts of) the latch. Such stress concentration may result in wear, damage, or even malfunction of the latch. In the present pile guide, however, such stresses are reduced or prevented.

The translations first and second directions need not be linear but may have a curvature and/or may be arranged at a non-straight angle, as long as the main directions of extension of both directions are generally perpendicular to each other.

In an embodiment, at least one of the first and second points of rotation is supported by, in particular: on, an adjustable support member mounted on the base frame, such that by adjustment of the support member, the respective point of rotation is translatable in the first direction with respect to the base frame. Thus, the position of the respective point of rotation is well controllable with respect to the base frame. The more direct the support is, the better control is possible, as (effects of) intermediate structures are obviated.

The superstructure may comprise a single guide member, but provision of plural pile guide members is also conceivable. In a pile guide with a single guide member, focusing of stresses in a relatively delicate part such as a latch would be more easily possible, but that is prevented as set out above. In a pile guide with plural pile guides, the superstructure may be accordingly enlarged; the possible increased stresses and deformations are mitigated or prevented by the present pile guide.

In an embodiment, at least one of the points of rotation is defined by a joint, at least part of the joint being movable with respect to the base frame. A joint, e.g. a hinge, in particular a joint comprising bearings, allows defining the point of rotation accurately, e.g. relative to a mere supporting surface on which the rotary object lies. By moving part of the joint the position of the point of rotation can be reliably shifted.

In a particular embodiment, at least one of the pile guide members comprises plural guide parts each moveable between a operative position and an inoperative position, each guide part being pivotally mounted on the base frame about a respective pivoting axis, wherein at least one of the respective pivoting axes is rotatable about the first and/or second point of rotation. Such pile guide allows a relatively simple and robust construction.

In such particular embodiment, each guide part may be pivotally mounted on the base frame about a respective pivoting axis for opening of the guide member to its inoperative position under gravity. Opening under gravity obviates (apparatus for) active driving of the guide members and provides a reliable pile guide.

Is noted that reliability of a pile guide is particularly relevant for pile guides used under water, e.g. at tens to hundreds of meters below the sea level and/or in conditions where divers cannot operate and where at best remote operated vehicles (ROVs) provide the main, if not the only, tools for control and/or manipulation.

In such particular embodiment, one of the respective pivoting axes may be rotatable about the first point of rotation and another one of the respective pivoting axes may be rotatable about the second point of rotation. Thus, the arm is defined between different pivoting axes. This facilitates adjusting inclination of the guide member with reduced or no stress on the guide member which might otherwise cause shifting, deformation and/or separation of the guide parts, and/or focusing of forces and/or stresses in parts such as a connector or a latch aiming to keep the guide member closed.

In such particular embodiment, the respective pivoting axes may be substantially parallel on opposite sides of the guide member, with the first and second points of rotation being on opposite sides of the pile guide member. This facilitates construction and operation of a symmetric guide member with opposing guide parts, e.g. two guide parts, and it facilitates proper control of adjustment to a particular predetermined inclination.

In such particular embodiment, at least one of the respective pivoting axes may extend in an axial direction and may be slidable in axial direction with respect to the respective first or second point of rotation, e.g. according to the concepts of WO 2011/083324. Thus, the pile guide allows accounting for differences between the physical length of the pivoting axis relative to the separation of the first and second points of rotation and a projection of that axis relative to that separation.

In an example of such particular embodiment, at least one of the pile guide members comprises a first guide part and a second guide part each moveable between a operative position and an inoperative position, the first guide part being pivotally mounted on the base frame about a first pivoting axis positioned on a first side of the guide member, and the second guide part being pivotally mounted on the base frame about a second pivoting axis positioned on an opposite side of the guide member with respect to the first pivoting axis, the first and second pivoting axes being substantially parallel to each other and extending in axial direction. The first pivoting axis is rotatable about the first point of rotation and a third point of rotation, and the second pivoting axis is rotatable about the second point of rotation and a fourth point of rotation. The first pivoting axis is slidable in the axial direction with respect to the first or third point of rotation and the second pivoting axis is slidable in the axial direction with respect to the second or fourth point of rotation. Thus, the inclination of guide member may be adjusted with reduced stresses in two mutually perpendicular directions, yet the adjustment is reliably definable with respect to the base frame via at least one of the first and second pivoting points.

In an aspect, and generally in accordance with the preceding, a method of operating a pile guide is provided, which comprises arranging a pile guide on a substrate, the pile guide comprising a base frame and a superstructure, the superstructure comprising a pile guide member for guiding the pile in a predetermined direction as it is driven into a substrate when the base frame is resting thereon, wherein at least part of the superstructure defines an arm that is rotatable with respect to the base frame about a first point of rotation and a second point of rotation, to rotate the pile guide member with respect to the base frame. The method comprises translating at least one of the first and second points of rotation with respect to the base frame in a first direction, thereby rotating the arm about the first and second points of rotation, and translating at least one of the first and second points of rotation in a second direction substantially perpendicular to the first direction.

Thus, the relative inclination of the superstructure and the base frame may be reliably adjusted.

BRIEF DESCRIPTION OF THE DRAWINGS

The above-described aspects will hereafter be more explained with further details and benefits with reference to the drawings showing an embodiment of the invention by way of example.

DETAILED DESCRIPTION OF EMBODIMENTS

Figure 2:
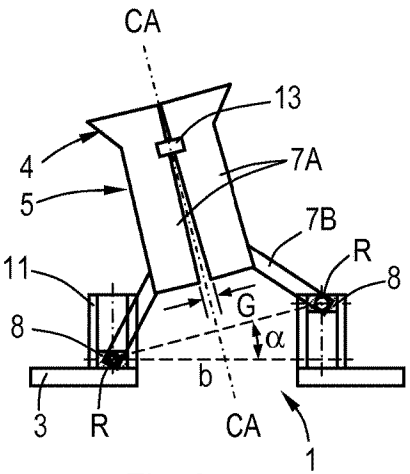
FIG. 2 shows the pile guide of FIG. 1 being inclined with respect to the base frame.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral.

Figure 1A:
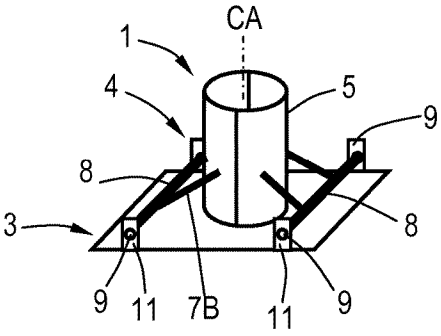
FIGS. 1 and 1A are side and perspective views of a known pile guide in generally perpendicular orientation of the pile guide relative to the base frame.
Figure 1:
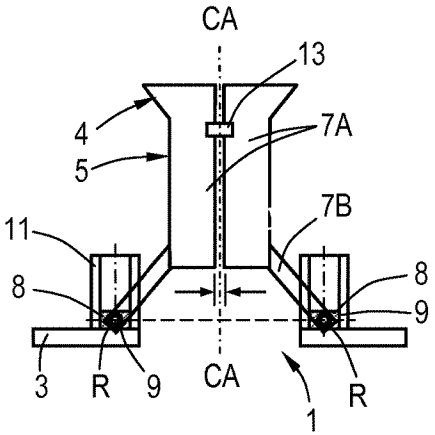
Figure 3:
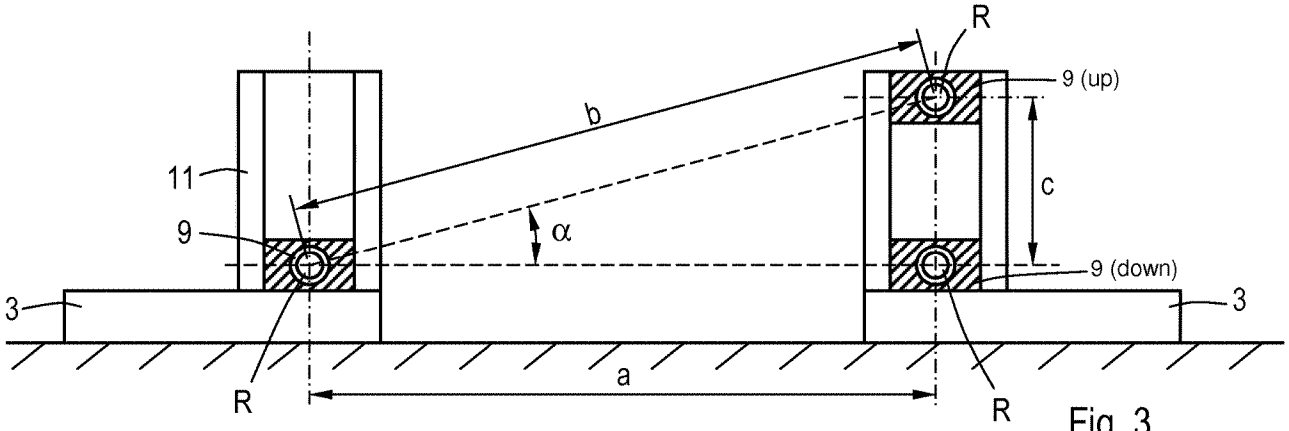
FIG. 3 schematically shows a detail of the pile guide of FIGS. 1-2.

FIGS. 1-3 show a pile guide 1, for supporting a pile as it is driven into a substrate, with FIG. 3 only showing a detail. The pile guide 1 comprises a base frame 3 and a superstructure 4, here mainly being a pile guide member 5 for guiding the pile (not shown) as it is driven into a substrate (not shown) when the base frame is resting thereon. Typically, the pile guide 1 is used for driving piles under water in a seabed, river bed or the like, and the base frame 3 may also be referred to as a "mud mat".

The pile guide member 5 extends along a central axis CA and comprises two guide parts 7, in turn comprising a generally concave main body portion 7A and a support frame 7B. Each guide part 7 is pivotally mounted on the base frame 3 for rotation about a respective pivot axis 8 and movable by rotation about the axes 8 between a closed operative position (shown) and an open inoperative position (not shown here, but detailed in the aforementioned WO publications). In the closed situation, the guide parts 7 are connected by a latch 13, usually a pair of latches 13 arranged at or near the top of the guide member 5. The pivot axes 8 extend generally parallel to each other and perpendicular to the central axis CA, and perpendicular to the plane of FIGS. 1, 2 and 3, FIG. 1A being a perspective view. Each guide part 7 may be coupled with an associated counterweight (not shown) for opening of the guide member 5 under gravity, and/or they may be coupled with another device for opening under action by the device.

The superstructure 4 is generally rigid and is connected to the pivot axes 8. The superstructure 4 defines an (imaginary) arm extending through both joints 9. The separation between the joints 9 has a base length b. The length of the arm also equals b.

The pivots axes 8 are rotatably mounted in joints 9 which are supported in adjustable support members 11 mounted on the base frame 3 and extending substantially perpendicular to it. E.g., the support member 11 may comprise a rail along which part of the joint 9 is movable e.g. by being supported by a hydraulic piston.

In the configuration of FIGS. 1-1A, the joints 9 are at equal heights above the base frame 3 and the base frame 3 and (the axes 8 of) the superstructure 4 are generally parallel.

As an example of adjustment of a support member 11, e.g. on the right-hand side of the pile guide 1, the respective joint 9, and with it the pivot axis 8, is translatable in a first direction (here: vertical) with respect to the base frame 3 (compare FIGS. 1-3). E.g., in the configuration of FIGS. 2 and 3, the positions of the joints 9 relative to the base frame 3 are adjusted by raising the right joint 9 with respect to the configuration of FIG. 1 over a distance c by adjustment of the respective support member 11. As a consequence, the superstructure 4 with the guide member 5 is inclined with respect to the base frame 3 (FIG. 2) over an angle $\alpha$, wherein the connections of the superstructure 4 with the base frame 3 provide points of rotation R with respect to the base frame, here coinciding with the pivot axes 8 which rotate in the joints 9.

However, (FIGS. 2-3) the lateral separation a of the support members 11 is constant, whereas the separation b of the joints 9 along the direction of the arm increases according to: separation=a tan $\alpha$, the tangent having an approximately linear relation to the angle $\alpha$ for small values of that angle. This results in stress in the pile guide 1 which may cause deformation of one or more portions of the pile guide 1. As a result of such stress, the guide parts 7 may separate at least partially and produce a gap G when held together by the latch 13, as indicated in FIG. 2. Thus, the latch 13 is subject to undesired loads and the guiding of the pile and/or reliability of the pile guide 1 may be compromised. Since the stresses scale with the arm length a, the problem gets worse with increasing size of the superstructure 4.

The customary strategy of fortifying the pile guide 1 to combat such stresses causes significant increases in the mass of the apparatus. Therefore, sizes of existing pile guides tend to be limited in practice. It also amounts to combating symptoms without addressing their cause.

Figure 5:
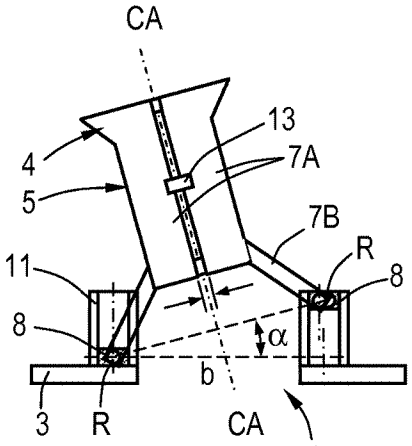
FIGS. 4-6 are views like FIGS. 1-3 of an improved pile guide.
Figure 4A:
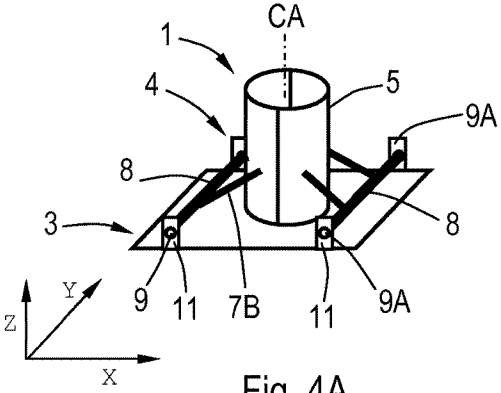
Figure 4:
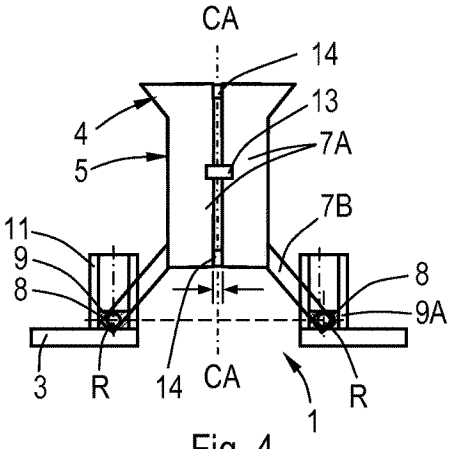
Figure 6:
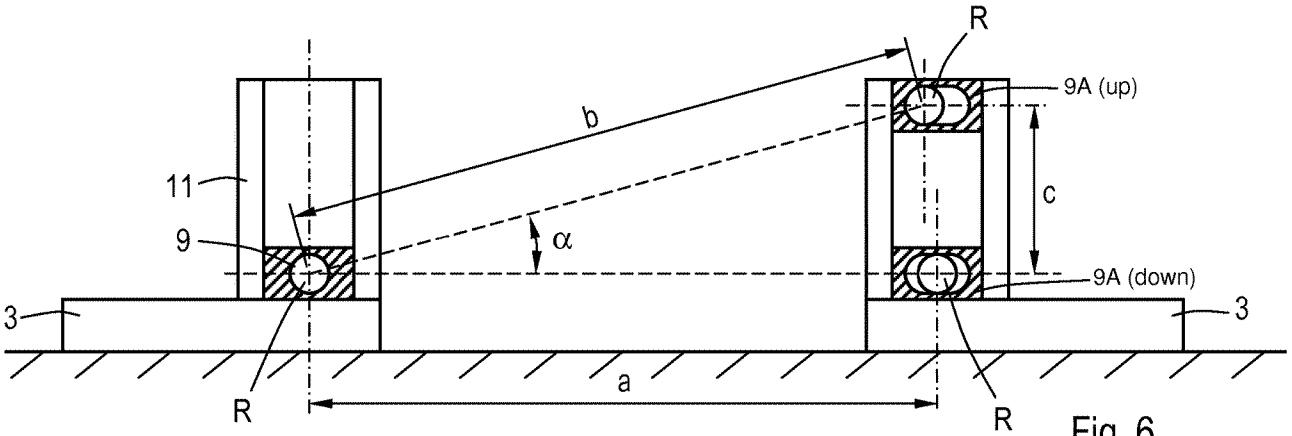

FIGS. 4-6 show, in similar views as FIGS. 1-3, an improved pile guide 1. This embodiment is largely similar to the pile guide 1 of FIGS. 1-3. However, in this embodiment joints 9A are provided, wherein the pivot axes 8 are translatable parallel to the base frame 3, perpendicular to the vertical direction. Here, the pivot axes 8 are generally freely sideways floatable in the joints 9A in the support members 11. Thus, when inclining the superstructure as before (compare FIGS. 5-6 with FIGS. 2-3) the lateral separation a of the support members 11 is constant, but now the separation b of the joints 9 along the direction of the arm is maintained constant, and the lateral separation of the pivot axes 8 (parallel to the base substrate 3) is reduced with a cos α (separation=b cos α, in this case). Thus, stresses on the pile guide 1 are reduced, and deformation of the guide member 5, which may lead to the aforementioned gap G between the guide members 7, is prevented. Also, the latch 13 may be constructed lighter-weight and/or it may be arranged at a different position so that forces in the guide member 5 are distributed more evenly. The guide parts 7 may be supported off each other with optional contact pads 14 further evening forces within the guide member 5. Further, larger pile guides may be constructed robustly at more easily manageable weight.

In the embodiment of FIG. 4A, two pivot axes 8 extend parallel in a Y-direction and are adjacent to each other in an X-direction, being supported in opposite adjustable supports 11 (as indicated in the reference-axes frame for directions X, Y and Z). By individual and/or pairwise adjustment of supports 11 in Z-direction, the positions of the joints 9A may be adjusted and thus the orientation of pivot axes 8 and that of (the central axis CA of) the pile guide member 5 as a whole may be adjusted relative to the base frame 3 in arbitrary directions, e.g. inclining the pile guide member 5 in X- and/or Y-direction(s). To prevent stresses in the pile guide 1, one or more joints 9A may (also) be constructed to allow motion of the respective pivot axis 8 in longitudinal direction of that axis, e.g. as in accordance with the concepts of WO 2011/083324. Both the presently provided concepts and those of WO 2011/083324 may be combined in a single joint assembly, e.g. by arranging a pivot longitudinally slidably in a bush- or ball shaped joint member, that, in turn, is laterally slidable in a counter part which is translatable perpendicular to the direction of lateral sliding, e.g. substantially perpendicular to the base frame 3 or the superstructure 4.

The principles of operation and their benefits apply equally well when the left-hand joint 9 is translated vertically by its support member 11 with or without vertical translation of the right-hand joint 9 by its support member 11, and/or if both joints are configured for lateral motion of the respective point of rotation R (here: the respective pivot axis 8).

Figure 7:
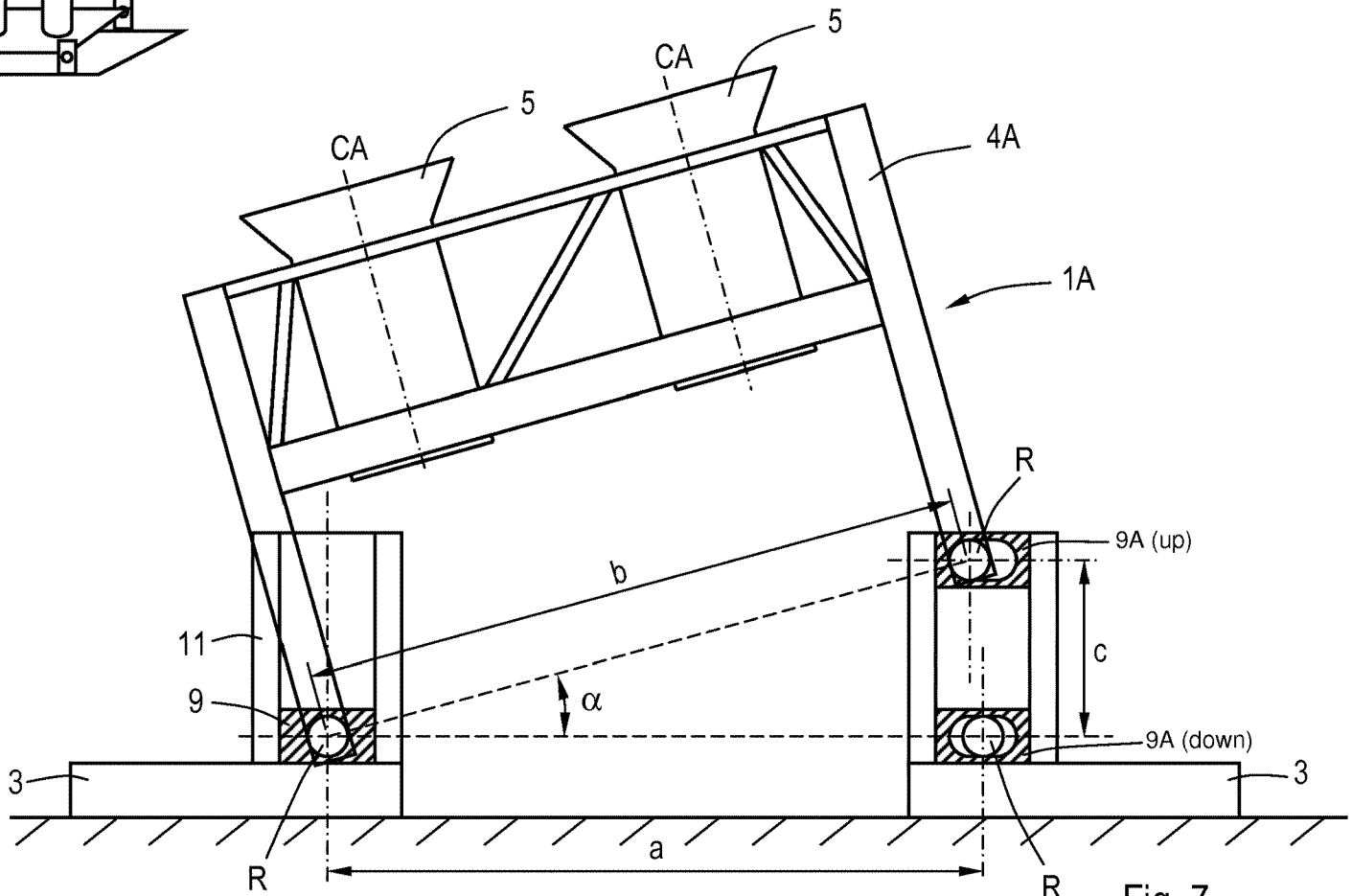
FIGS. 7-7A are side and perspective views like FIGS. 3, 6 and 1A, 4A, respectively, of an improved pile guide.
Figure 7A:
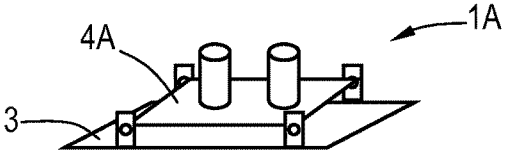

FIG. 7 is a side view of another embodiment, comprising a superstructure 4A having plural pile guide members 5, one or more of which may have guide parts 7 that are moveable between an operative position and an inoperative position (not shown). FIG. 7A is a (very) schematic perspective view of this pile guide 1A. In this embodiment, four corners of the superstructure 4A are supported so as to be translatable perpendicular to the base frame 3, so that the superstructure 4A may be inclined to the base frame 3, like the superstructure 4 of FIGS. 4-6. The connections between the base frame 3 and the superstructure 4A provide points of rotation R of the parts (3, 4A) with respect to each other, between which points of rotation R the (imaginary) arm is spanned, having length b. Due to the lateral freedom of motion of the point of rotation R (right side in FIG. 7), both the arm length b and the separation a between supports 11 can be maintained substantially constant under adjustment of the angle of inclination a to reduce or prevent stresses and/or deformation. Here, again, the points of rotation R are moveable by a floatable joint 9A, however, the points of rotation R do not coincide with pivot axes 8. Otherwise, the embodiment and its operation are largely similar to that of FIGS. 4-6.

The inclination of (a superstructure 4, 4A of) a pile guide 1, 1A as provided herewith may be adjustable in two substantially perpendicular directions, so that the central axis CA of the guide member 5 may be arranged in arbitrary desired orientations over an available solid angle e.g. defined by adjustable support members. In such case, more points of rotation R are present which may be translatable in a direction generally parallel to the base frame 3 or the superstructure 4, 4A, perpendicular to the respective direction of translation for adjustment of the inclination.

It is noted that a translatable joint is suitable, e.g. having a floatable bush and/or bearing, but a pivot slidably resting on a support and/or suspended from a laterally deformable object such as a chain or cable could be envisioned.

Summarising, operation and use of the pile guide (e.g. 1) may comprise the following steps:

a) arranging an embodiment of a pile guide 1 as described herein on a substrate, e.g. underwater, on the seabed;

b) translating at least one of the first and second points of rotation with respect to the base frame 3 in a first direction, thereby rotating the arm about the first and second points of rotation, and c) translating at least one of the first and second points of rotation in a second direction substantially perpendicular to the first direction.

In an embodiment, the steps b and c are performed substantially concurrently, which prevents arm length variations and/or stresses during either translation.

In view of the harsh conditions of pile driving, in particular offshore subsea pile driving, pile guides have traditionally been developed with continuously increased robustness and simplicity, reducing the number of parts and/or providing parts as unitary objects and/or substantially permanently fixed together objects (e.g. welded or riveted) wherever possible. It has now been found that such robustness may, in fact, not be needed and that, by increasing complexity of the pile guide against the traditional trend, by making parts movable with respect to each other, the pile guide's overall robustness may be increased and its weight may be significantly reduced.

The invention is not restricted to the above described embodiments which can be varied in a number of ways within the scope of the claims. For instance it is possible that more or less and/or different translators are provided to translate the points of rotation than the shown and discussed support members 11. Lateral translation may be passively, e.g. floating, and/or under operation of one or more actuators, e.g. comprising one or more hydraulic cylinders. Further, more guide parts may be used in a superstructure, the guide member and/or guide part frame may differ, the base frame may be smaller, larger and/or differently formed, etc. Also, plural pile guides may be combined, possibly detachably, to a multi-pile guide template. Connections for hoisting arrangements and/or for connecting with an Remotely Operated Vehicle (ROV) e.g. for power requirements may be provided.

Elements and aspects discussed for or in relation with a particular embodiment may be suitably combined with elements and aspects of other embodiments, unless explicitly stated otherwise.

The invention claimed is:

1. A pile guide comprising:

a base frame, and a superstructure, the superstructure comprising a pile guide member configured to guide a pile in a predetermined direction as it is driven into a substrate when the base frame is resting thereon, wherein at least part of the superstructure defines an imaginary arm of fixed length that is rotational with respect to the base frame about a first axis of rotation extending through a first point of rotation separated from the pile guide member and about a second axis of rotation extending through a second point of rotation separated from the pile guide member, to rotate the pile guide member with respect to the base frame, a separation of the first point of rotation and the second point of rotation defining the fixed length of the imaginary arm, wherein at least one of the first and second points of rotation is translatable with respect to the base frame in a first direction substantially perpendicular to the base frame, thereby rotating the imaginary arm about the first and second points of rotation with respect to the base frame, and wherein at least one of the first and second points of rotation is translatable with respect to the base frame in a second direction substantially perpendicular to the first direction maintaining the separation of the first and second points of rotation along the direction of the length the imaginary arm constant, and wherein the first direction and the second direction are substantially perpendicular to the first axis of rotation and the second axis of rotation.

2. The pile guide of claim 1, wherein at least one of the first and second points of rotation is floatable in the second direction substantially perpendicular to the first direction.

3. The pile guide of claim 1, wherein at least part of the pile guide member defines the imaginary arm.

4. The pile guide of claim 1, wherein at least one of the first and second points of rotation is supported by an adjustable support member mounted on the base frame, such that by adjustment of the support member, the respective point of rotation is translatable in the first direction with respect to the base frame.

5. The pile guide of claim 1, wherein the superstructure comprises plural pile guide members.

6. The pile guide of claim 1, wherein at least one of the first and second points of rotation is defined by a joint, at least part of the joint being movable with respect to the base frame, wherein the pile guide member has a central axis from a first end proximate the substrate and a second end remote from the substrate, the central axis extending in the predetermined direction, the superstructure being movably supported on the frame to allow movement of the pile guide member in a direction having a component along the central axis.

7. The pile guide of claim 6, wherein the joint has a floatable bush or bearing.

8. The pile guide of claim 6, wherein the joint includes an elongate slot, and wherein the at least one of the first and second points of rotation is arranged to pass through a floating member that is translatable within the elongate slot.

9. The pile guide of claim 1, wherein the pile guide member comprises a plurality of guide parts each moveable between an operative position and an inoperative position, each guide part being pivotally mounted on the base frame about a respective pivoting axis, wherein at least one of the respective pivoting axes is rotatable about at least one of the first and second points of rotation.

10. The pile guide of claim 9, wherein each guide part is pivotally mounted on the base frame about a respective pivoting axis for opening of the pile guide member to its inoperative position under gravity.

11. The pile guide of claim 9, wherein one of the respective pivoting axes is rotatable about the first point of rotation and another one of the respective pivoting axes is rotatable about the second point of rotation.

12. The pile guide of claim 9, wherein the respective pivoting axes are substantially parallel on opposite sides of the pile guide member and the first and second points of rotation are on opposite sides of the pile guide member.

13. The pile guide of claim 9, wherein at least one of the respective pivoting axes extends in an axial direction and is slidable in the axial direction with respect to the respective first or second point of rotation.

14. The pile guide of claim 9, wherein the pile guide member comprises a first guide part and a second guide part each moveable between an operative position and an inoperative position, the first guide part being pivotally mounted on the base frame about a first pivoting axis positioned on a first side of the pile guide member, and the second guide part being pivotally mounted on the base frame about a second pivoting axis positioned on an opposite side of the pile guide member with respect to the first pivoting axis, the first and second pivoting axes being substantially parallel to each other and extending in an axial direction, wherein the first pivoting axis is rotatable about the first point of rotation and a third point of rotation, and the second pivoting axis is rotatable about the second point of rotation and a fourth point of rotation, wherein the first pivoting axis is slidable in the axial direction with respect to the first or third point of rotation, and the second pivoting axis is slidable in the axial direction with respect to the second or fourth point of rotation.

15. The pile guide of claim 14, wherein at least one of the third and fourth points of rotation is translatable with respect to the base frame in the first direction.

16. A method of operating a pile guide comprising:

arranging a pile guide on a substrate, the pile guide comprising a base frame and a superstructure, the superstructure comprising a pile guide member for guiding a pile in a predetermined direction along a central axis as it is driven into a substrate when the base frame is resting thereon, the superstructure being movably supported on the frame to allow movement of the pile guide member in a direction having a component along the central axis, wherein at least part of the superstructure defines an imaginary arm of fixed length between a first point of rotation and a second point of rotation that is rotatable with respect to the base frame about the first point of rotation and the second point of rotation, to rotate the pile guide member with respect to the base frame, translating at least one of the first and second points of rotation with respect to the base frame in a first direction, thereby rotating the imaginary arm about the first and second points of rotation, wherein the first direction is substantially perpendicular to the base frame, and translating at least one of the first and second points of rotation with respect to the base frame in a second direction substantially perpendicular to the first direction due to rotation of the imaginary arm of fixed length which maintains a constant separation between the first point of rotation and the second point of rotation during rotation of the imaginary arm.

17. A pile guide comprising:

a base frame, and a superstructure, the superstructure comprising a pile guide member configured to guide a pile in a predetermined direction as it is driven into a substrate when the base frame is resting thereon, the pile guide member having a central axis from a first end proximate the substrate and a second end remote from the substrate, the central axis extending in the predetermined direction;

wherein at least part of the superstructure defines an imaginary arm of fixed length between a first point of rotation and a second point of rotation that is rotational with respect to the base frame about the first point of rotation and the second point of rotation, each point of rotation being where a portion of the superstructure is connected to and rotates with respect to the base frame, wherein the superstructure is movably supported on the frame to allow movement of the pile guide member in an axial direction along the central axis, wherein at least one of the first and second points of rotation is translatable with respect to the base frame in a first direction substantially perpendicular to the base frame, thereby rotating the imaginary arm of fixed length about the first and second points of rotation with respect to the base frame, and wherein at least one of the first and second points of rotation is translated in a second direction with respect to the base frame substantially perpendicular to the first direction when the imaginary arm of fixed length rotates.

18. The pile guide of claim 17 wherein each of the first point of rotation and the second point of rotation are separate from the pile guide member.

19. The pile guide of claim 18 wherein the imaginary arm is configured such that when at least one of the first and second points of rotation is translatable in the second direction a length of the imaginary arm maintained constant.

20. The pile guide of claim 17 wherein the imaginary arm is configured such that when at least one of the first and second points of rotation is translatable in the second direction a length of the imaginary arm maintained constant.

* * * * *